US009247344B2

(12) United States Patent
Liu et al.

(10) Patent No.: US 9,247,344 B2
(45) **Date of Patent: *Jan. 26, 2016**

(54) LOUDSPEAKER

(71) Applicants: Tsinghua University, Beijing (CN); HON HAI PRECISION INDUSTRY CO., LTD., New Taipei (TW)

(72) Inventors: Liang Liu, Beijing (CN); Jia-Ping Wang, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 130 days.

This patent is subject to a terminal disclaimer.

(21) Appl. No.: 13/906,993

(22) Filed: May 31, 2013

(65) Prior Publication Data

US 2013/0266159 A1 Oct. 10, 2013

Related U.S. Application Data

(63) Continuation of application No. 12/824,395, filed on Jun. 28, 2010, now Pat. No. 8,467,564.

(30) Foreign Application Priority Data

Aug. 5, 2009 (CN) ..... 2009 1 01095671

(51) Int. Cl.
*H04R 25/00* (2006.01)
*H04R 3/00* (2006.01)
(Continued)

(52) U.S. Cl.
CPC .. *H04R 3/00* (2013.01); *H04R 1/00* (2013.01); *H04R 9/02* (2013.01); *H04R 23/002* (2013.01); *H04R 2201/028* (2013.01); *H04R 2205/021* (2013.01)

(58) Field of Classification Search
CPC .. H04R 1/00; H04R 23/002; H04R 2201/028; H04R 2205/02; H04R 3/00; H04R 9/02
USPC ..... 381/164
See application file for complete search history.

(56) References Cited

U.S. PATENT DOCUMENTS 4,312,118 A 1/1982 Saik et al.
2003/0133581 A1 * 7/2003 Klayman ..... 381/152
(Continued)

OTHER PUBLICATIONS

Sanders, Robert. "Single Nanotube Makes World's Smallest Radio," Oct. 31, 2007, UC Berkeley News. http://www.berkeley.edu/news/media/releases/2007/10/31_NanoRadio.shtml.*
(Continued)

*Primary Examiner* — Matthew Eason
*Assistant Examiner* — Sean H Nguyen
(74) *Attorney, Agent, or Firm* — Novak Druce Connolly Bove + Quigg LLP

(57) ABSTRACT

A loudspeaker includes a magnetic system defining a magnetic gap, a vibrating system, and a supporting system. The vibrating system includes a diaphragm, a voice coil bobbin disposed in the magnetic gap, a coil lead wire having a first end and a second end, and a voice coil wound around the voice coil bobbin and electrically connected to the first end. The supporting system includes a frame fixed to the magnetic system and receiving the vibrating system. The frame has a terminal electrically connected to the second end of the coil lead wire. The diaphragm is received in the frame. The voice lead wire includes at least one carbon nanotube wire structure. The carbon nanotube wire structure includes a plurality of carbon nanotubes.

18 Claims, 8 Drawing Sheets

(51) Int. Cl.

| | |
|---|---|
| ***H04R 1/00*** | (2006.01) |
| ***H04R 23/00*** | (2006.01) |
| ***H04R 9/02*** | (2006.01) |

(56) References Cited

U.S. PATENT DOCUMENTS

| | | | | |
|---|---|---|---|---|
| 2004/0197006 | A1* | 10/2004 | Suzuki et al. | 381/410 |
| 2007/0116957 | A1* | 5/2007 | Pan et al. | 428/408 |
| 2009/0074228 | A1 | 3/2009 | Mango, III et al. | |
| 2009/0117434 | A1 | 5/2009 | Liu et al. | |
| 2009/0169463 | A1* | 7/2009 | Smalley et al. | 423/445 B |
| 2009/0197082 | A1 | 8/2009 | Jiang et al. | |

OTHER PUBLICATIONS

Yu et a., Carbon Nanotube-Based Transparent Thin Film Acoustic Actuators and Sensors, Sep. 16, 2005, Elsevier, Sensors and Actuators A 132 (2006), p. 626-631.*

Loudspeakers: Nanotunes, Nov. 20, 2008, The Economist, p. 1-2.*

Barkaline et al., Acoustic Properties of Carbon Nanotube Arrays as Chemical Sensor Elements, Feb. 3, 2008, Rev.Adv.Mater.Sci. 20(2009), p. 28-36.*

* cited by examiner

LOUDSPEAKER

CROSS-REFERENCE TO RELATED APPLICATIONS

This application is a continuation of U.S. patent application Ser. No. 12/824,395, filed on Jun. 28, 2010, entitled, "LOUDSPEAKER", which claims all benefits accruing under 35 U.S.C. §119 from China Patent Application No. 200910109567.1, filed on Aug. 5, 2009, in the China Intellectual Property Office, the contents of which are hereby incorporated by reference.

BACKGROUND

1. Technical Field

The present disclosure relates to loudspeakers, and particularly, to an electrodynamic loudspeaker.

2. Description of Related Art

Electrodynamic loudspeakers are generally used to produce sound output from audio electrical signals. In operation, an audio electrical signal is input into a coil lead wire, which is electrically connected to a voice coil of the electrodynamic loudspeaker. The coil lead wire transmits the audio electrical signal into the voice coil. The voice coil produces a changing magnetic field around the voice coil. The changing magnetic field interacts with a magnetic field produced by a permanent magnet to produce reciprocal forces on the voice coil. The voice coil oscillates in accordance with the reciprocal forces, and, correspondingly, the coil lead wire is repeatedly bent due to the oscillation of the voice coil. The voice coil is attached to a diaphragm which vibrates in response to the force applied to the voice coil. The vibration of the diaphragm produces sound waves in the ambient air.

Presently, the coil lead wire is formed by intertwisting a plurality of metal wires. However, the metal wires have poor strength. A fatigue fracture of the metal wires in the coil lead wire, caused during the deforming process of the coil lead wire, makes the loudspeaker inoperative. Thus, the lifespan of the loudspeaker is reduced.

What is needed, therefore, is to provide a loudspeaker which has a coil lead wire resisting fatigue fracture.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
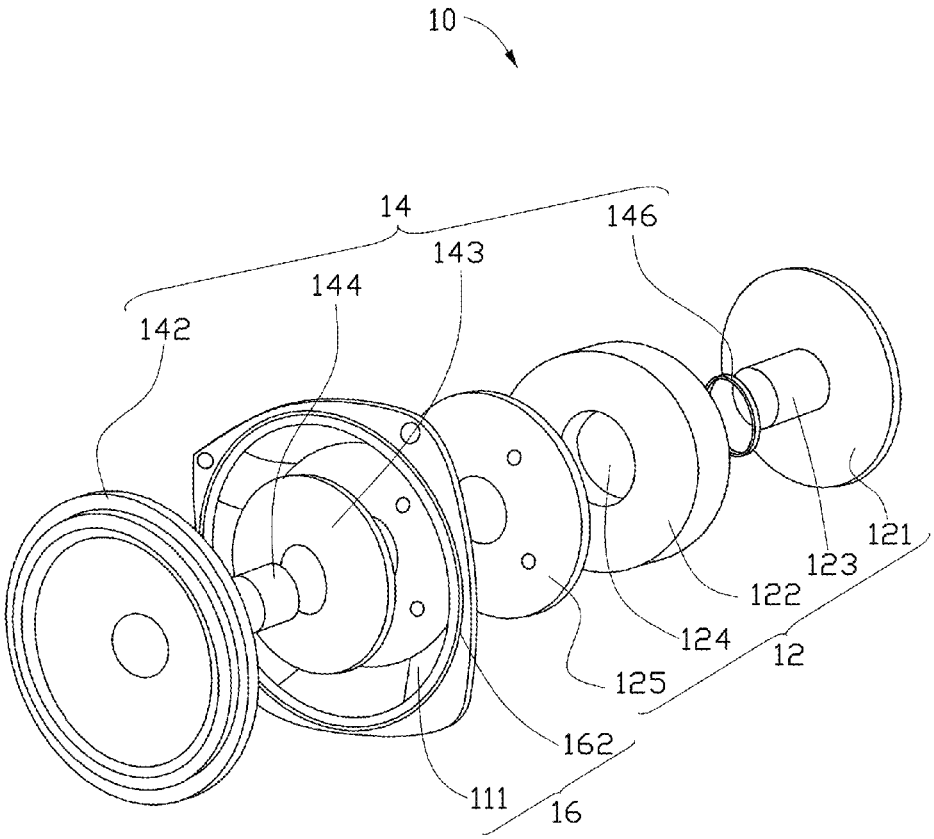
FIG. 1 is a structural schematic view of one embodiment of a loudspeaker.
Figure 2:
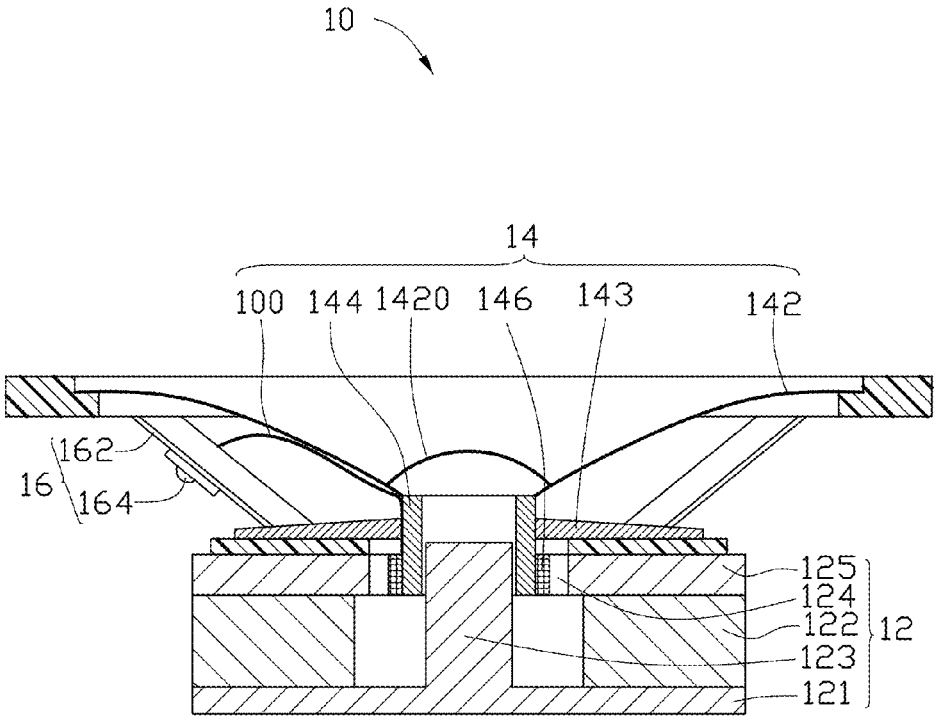
FIG. 2 is a sectional view of the loudspeaker of FIG. 1.

FIGS. 1 and 2 show one embodiment of a loudspeaker 10. The loud speaker 10 includes a magnetic system 12, a vibrating system 14, and a supporting system 16.

The magnetic system 12 includes a back plate 121 having a center pole 123, a top plate 125, and a magnet 122. The back plate 121 and the top plate 125 are coaxial and opposite to each other. The magnet 122 is fixed between the top plate 125 and the back plate 121. The top plate 125 and the magnet 122 are annular in shape. The top plate 125 and the magnet 122 cooperatively define a column space. The center pole 123 projects into the column space. The center pole 123, the magnet 122, and the top plate 125 are dimensioned and shaped to cooperatively define an annular magnetic gap 124.

The vibrating system 14 includes a diaphragm 142, a voice coil bobbin 144, a voice coil 146, a damper 143 defining a through hole 1430, and a coil lead wire 100. The diaphragm 142 has a funnel configuration and includes a dome 1420 protruding from a center of the bottom thereof to define a concave facing the bobbin 144. The bobbin 144 surrounds the center pole 123, and is disposed in the magnetic gap 124 and limited to move along an axial direction of the center pole 123. The bobbin 144 extends through the through hole 1430 to fix the diaphragm 142 and the damper 143 thereon. The voice coil 146 is received in the magnetic gap 124, and wound around the bobbin 144. The coil lead wire 100 includes a first end (not labeled) electrically connected to the voice coil 146 and a second end (not labeled) attached to the supporting system 16.

The supporting system 16 includes a frame 162 to contain the vibrating system 14. The frame 162 can be frustum shaped, and have a cavity 161 and a bottom 163 with an opening 111. The bobbin 144 extends through the opening 111, the top plate 125, the magnet 122 and is received in the magnetic gap 124 so that the magnetic system 12, the vibrating system 14 and the supporting system 16 can be assembled together. The cavity 161 can receive the diaphragm 142 and the damper 143. The bottom 163 of the frame 162 is fixed to the top plate 125 of the magnetic system 12. The diaphragm 142 and the damper 143 are fixed to the frame 162. Additionally, a terminal 164 is disposed on the frame 162. The second end of the coil lead wire 100 can be directly connected to the terminal 164.

Furthermore, the coil lead wire 100 can be fixed to a surface of the diaphragm 142, and extend from the fixed position on the diaphragm 142 to the terminal 164. In the embodiment, the coil lead wire 100 can be adhered to the surface of the diaphragm 142 by, for example, an adhesive or fixed to the surface of the diaphragm 142 by a groove defined in the diaphragm 142. The second end of the coil lead wire 100 can be electrically connected to the terminal 164 by arbitrary means. For example, a short metal wire can be firstly welded with a conductive portion of the terminal 164, and then, the metal wire can be adhered to the coil lead wire 100 by an adhesive. The coil lead wire 100 can also be directly and electrically connected to the terminal 164.

Figure 3:
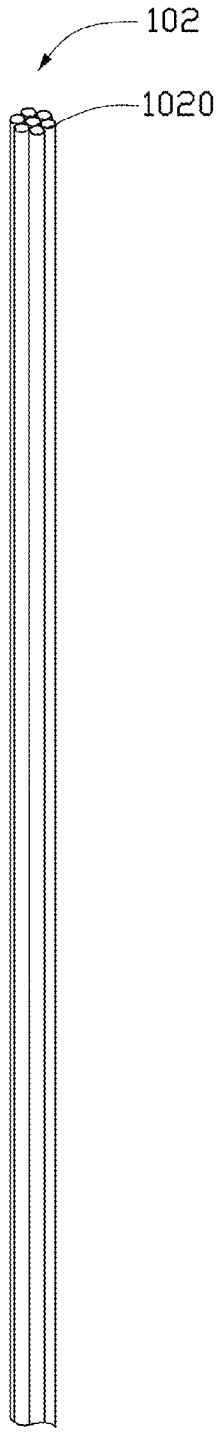
FIGS. 3 and 4 are structural schematic view of a carbon nanotube wire structure in a coil lead wire of the loudspeaker of FIG. 1.
Figure 4:
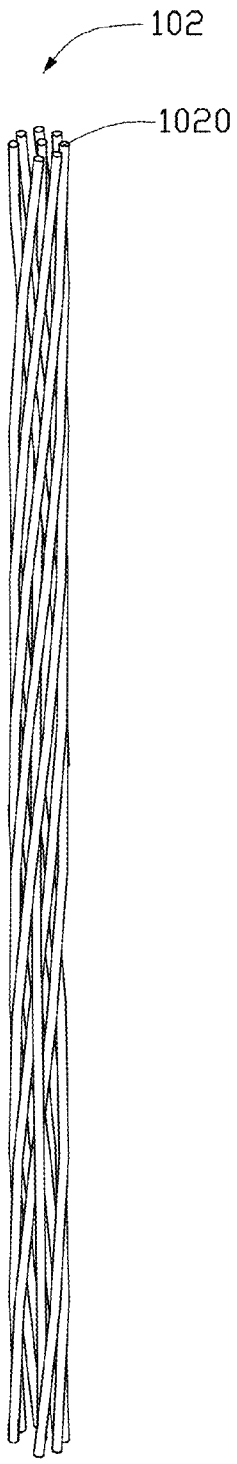

FIGS. 3 and 4 show that the coil lead wire 100 includes at least one carbon nanotube wire structure 102. The carbon nanotube wire structure 102 includes a plurality of carbon nanotubes joined end to end by van der Waals attractive force. The carbon nanotubes can be single-walled, double-walled, or multi-walled carbon nanotubes. A diameter of each single-walled carbon nanotube ranges from about 0.5 nanometers (nm) to about 10 nm. A diameter of each double-walled carbon nanotube ranges from about 1 nm to about 15 nm. A diameter of each multi-walled carbon nanotube ranges from about 1.5 nm to about 50 nm. The diameter of the carbon nanotube wire structure 102 can be set as desired. In use, the voice coil 146 oscillates linearly, and the coil lead wire 100 connected to the voice coil 146 is repeatedly bent in response to the oscillation of the voice coil 146. The coil lead wire 100 applies a load to the voice coil 146. Thus, the weight of the coil lead wire 100 influences the oscillation of the voice coil 146. In this embodiment, the greater the weight of the coil lead wire 10, the greater the load of the voice coil 146. Therefore, the voice coil 146 cannot oscillate properly, and the loudspeaker 10 can make a distorted sound. Thus, for the mechanical strength of the carbon nanotube wire structure 102 to be high enough such that the carbon nanotube wire structure 102 does not easily break, the diameter of the carbon nanotube wire structure 102 should be as small as possible. In one embodiment, the diameter of the carbon nanotube wire structure 102 is in a range from about 10 microns (μm) to 50 millimeters (mm).

The carbon nanotube wire structure 102 includes at least one carbon nanotube wire. FIG. 3 shows that the carbon nanotube wire structure 102 can be a bundle structure composed of a plurality of carbon nanotube wires 1020 substantially parallel to each other. FIG. 4 shows that the carbon nanotube wire structure 102 can also be a twisted structure composed of a plurality of carbon nanotube wires 1020 twisted together.

Figure 5:
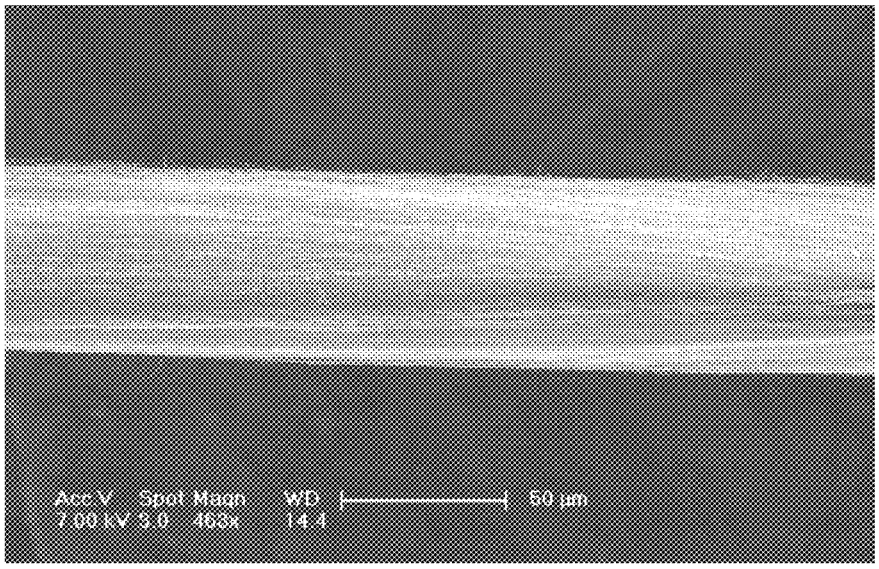
FIG. 5 is a Scanning Electron Microscope (SEM) image of a non-twisted carbon nanotube wire in the coil lead wire of the loudspeaker of FIG. 1.

The carbon nanotube wire 1020 can be a non-twisted carbon nanotube wire or a twisted carbon nanotube wire. FIG. 5 shows that the non-twisted carbon nanotube wire includes a plurality of carbon nanotubes substantially oriented along a same direction (e.g., a direction along the length of the non-twisted carbon nanotube wire). The carbon nanotubes are substantially parallel to the axis of the non-twisted carbon nanotube wire. In the embodiment, the non-twisted carbon nanotube wire includes a plurality of carbon nanotube joined end-to-end by van der Waals attractive force therebetween. A length of the non-twisted carbon nanotube wire can be arbitrarily set as desired. A diameter of the non-twisted carbon nanotube wire can range from about 0.5 nm to about 100 μm. The non-twisted carbon nanotube wire can be formed by treating a drawn carbon nanotube film with an organic solvent. In the embodiment, the drawn carbon nanotube film is treated by applying the organic solvent to the drawn carbon nanotube film to soak the entire surface of the drawn carbon nanotube film. After being soaked by the organic solvent, the adjacent substantially parallel carbon nanotubes in the drawn carbon nanotube film will bundle together, due to the surface tension of the volatile organic solvent as the organic solvent volatilizes, and thus, the drawn carbon nanotube film will be shrunk into a non-twisted carbon nanotube wire. The organic solvent can be ethanol, methanol, acetone, dichloroethane or chloroform. In one embodiment, the organic solvent is ethanol. The non-twisted carbon nanotube wire treated by the organic solvent has a smaller specific surface area and a lower viscosity than that of the drawn carbon nanotube film untreated by the organic solvent. An example of the non-twisted carbon nanotube wire is taught by US Patent Application Publication US 2007/0166223 to Jiang et al.

Figure 6:
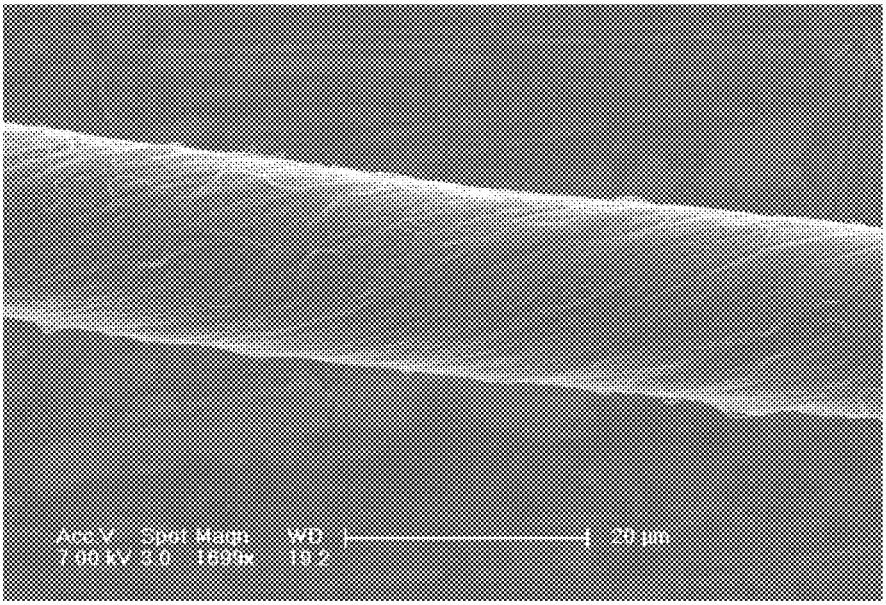
FIG. 6 is a SEM image of a twisted carbon nanotube wire in the coil lead wire of the loudspeaker of FIG. 1.

The twisted carbon nanotube wire can be formed by twisting a drawn carbon nanotube film by using a mechanical force to turn the two ends of the drawn carbon nanotube film in opposite directions. FIG. 6, the twisted carbon nanotube wire includes a plurality of carbon nanotubes oriented around an axial direction of the twisted carbon nanotube wire. The carbon nanotubes are aligned in a helix around the axis of the twisted carbon nanotube wire. More specifically, the twisted carbon nanotube wire includes a plurality of successive carbon nanotube segments joined end-to-end by van der Waals attractive force therebetween. Each carbon nanotube segment includes a plurality of carbon nanotubes substantially parallel to each other and combined by van der Waals attractive force. The carbon nanotube segment has arbitrary length, thickness, uniformity and shape. A length of the twisted carbon nanotube wire can be arbitrarily set as desired. A diameter of the twisted carbon nanotube wire can range from about 0.5 nm to about 100 μm. Further, the twisted carbon nanotube wire can be treated with a volatile organic solvent, before or after being twisted. After being soaked by the organic solvent, the adjacent parallel carbon nanotubes in the twisted carbon nanotube wire will bundle together, due to the surface tension of the organic solvent as the organic solvent volatilizes. The specific surface area of the twisted carbon nanotube wire will decrease, and the density and strength of the twisted carbon nanotube wire will be increased.

In addition, the coil lead wire 100 can be a bundle structure composed of a plurality of carbon nanotube wire structures 102 substantially parallel to each other. The coil lead wire 100 can also be a twisted structure composed of a plurality of carbon nanotube wire structures 102 that are twisted together.

The carbon nanotube wire structure 102 can improve the strength and bend resistance of the coil lead wire 100, because the carbon nanotube wire structure 102 comprises a plurality of carbon nanotubes joined end-to-end by van der Waals attractive force therebetween, which have high strength and bend resistance. In addition, the carbon nanotubes have a good conductive property along the length of the carbon nanotubes. Because the carbon nanotubes extend along the axis direction of the carbon nanotube wire structure 102, the conductivity of the coil lead wire 100 is improved. Furthermore, the lifespan of the loudspeaker 10 using the coil lead wire 100 can be prolonged.

Figure 7:
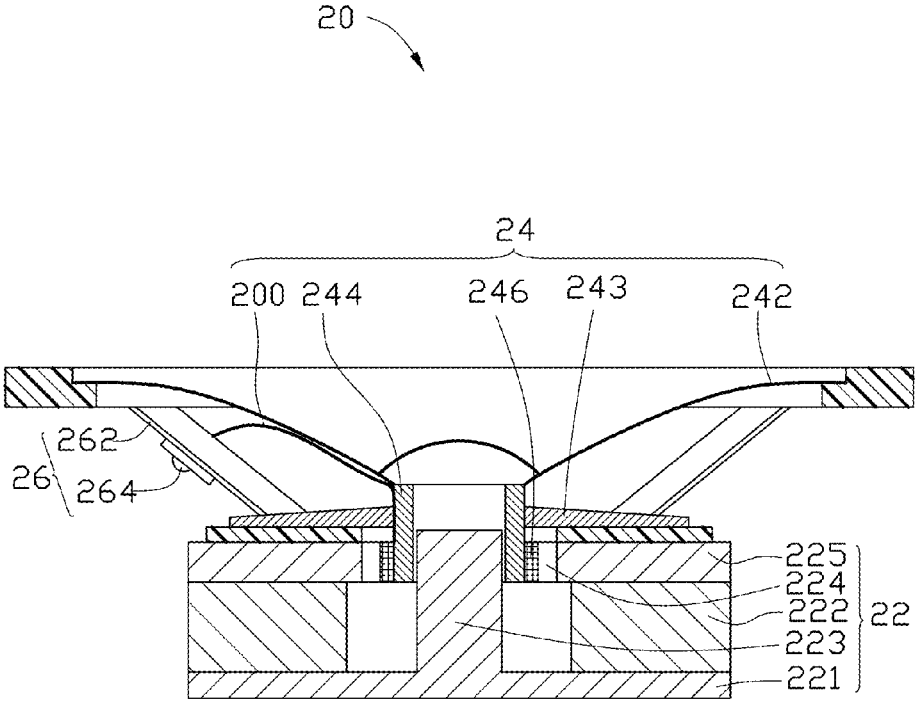
FIG. 7 is a structural schematic view of another embodiment of a loudspeaker.

FIG. 7 shows that another embodiment of a loudspeaker 20 includes a magnetic system 22, a vibrating system 24, and a supporting system 26. The magnetic system 22 includes a back plate 221 having a center pole 223, a top plate 225, and a magnet 222. The center pole 223, the magnet 222, and the top plate 225 are sized and shaped to cooperatively define an annular magnetic gap 224. The vibrating system 24 includes a diaphragm 242, a coil bobbin 244, a voice coil 246, a damper 243, and a coil lead wire 200. The supporting system 26 includes a frame 262 containing the vibrating system 24 and a terminal 264 disposed on the frame 262.

The coil lead wire 200 includes at least one carbon nanotube wire structure (not shown). The carbon nanotube wire structure can include at least one carbon nanotube wire. The carbon nanotube wire structure can be a bundle structure composed of a plurality of carbon nanotube wires substantially parallel to each other. The carbon nanotube wire structure can also be a twisted structure composed of a plurality of carbon nanotube wires twisted together.

Figure 8:
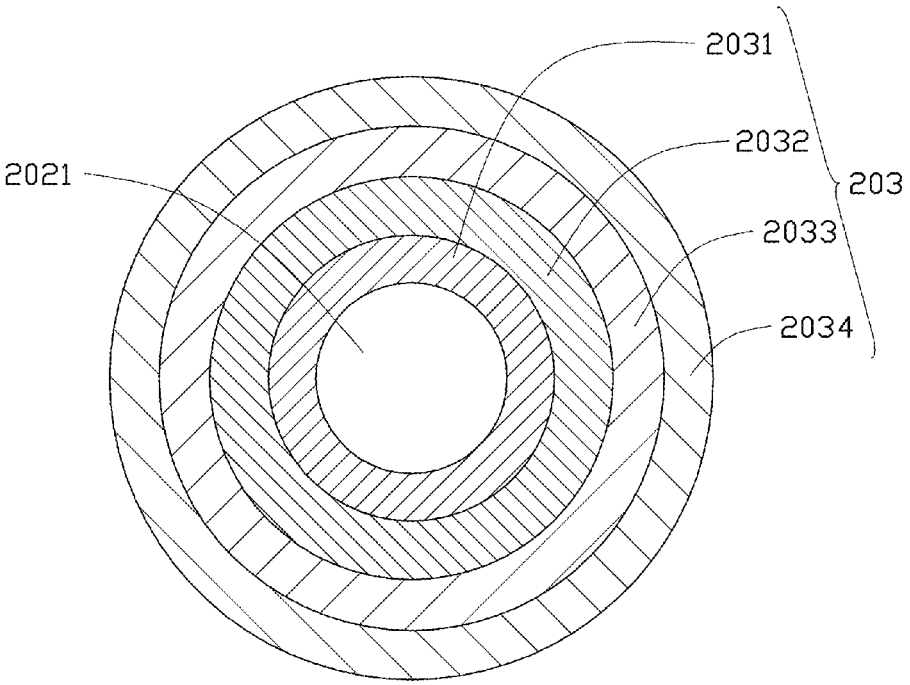
FIG. 8 is a structural schematic view of a carbon nanotube coated with a conductive structure.

FIG. 8 shows that the carbon nanotube wire includes a plurality of carbon nanotubes 2021 coated with a conductive structure 203. The conductive structure 203 includes a wetting layer 2031 applied to the outer circumferential surface of the carbon nanotubes 2021, a transition layer 2032 covering the outer circumferential surface of the wetting layer 2031, a conductive layer 2033 covering the outer circumferential surface of the transition layer 2032, and an anti-oxidation layer 2034 covering the outer circumferential surface of the conductive layer 2033.

Wettability between carbon nanotubes 2021 and most kinds of metal is poor. Therefore, the wetting layer 2031 can be configured to provide a good transition between the carbon nanotube 2021 and the conductive layer 2033. The wetting layer 2031 can be iron (Fe), cobalt (Co), nickel (Ni), palladium (Pd), titanium (Ti), or any combination alloy thereof. The thickness of the wetting layer 2031 can range from about 0.1 nm to about 10 nm. In one embodiment, the material of the wetting layer 2031 is nickel (Ni), and the thickness of the wetting layer 2031 is 2 nm. The wetting layer 2031 is optional.

The transition layer 2032 is arranged for combining the wetting layer 2031 with the conductive layer 2033. The material of the transition layer 2032 should be one that combines well both with the material of the wetting layer 2031 and the material of the conductive layer 2033. The thickness of the transition layer 2032 can range from about 0.1 nm to about 10 nm. In one embodiment, the material of the transition layer 2032 is copper (Cu), and the thickness of the transition layer 2032 is 2 nm. The transition layer 2032 is optional.

The material of the conductive layer 2033 should have good conductivity. The conductive layer 2033 can be copper (Cu), silver (Ag), gold (Au) or any combination alloy thereof. The thickness of the conductive layer 2033 can range from about 0.1 nm to about 20 nm. In one embodiment, the material of the conductive layer 2033 is silver (Ag), the thickness of the conductive layer 2033 is about 10 nm. The resistance of the carbon nanotube wire structure is decreased due to the conductive layer 2033, thereby improving the conductivity of the carbon nanotube wire structure.

The anti-oxidation layer 2034 is configured for preventing the conductive layer 2033 from being oxidized from exposure to the air and preventing reduction of the conductivity of the coil lead wire 200. The material of the anti-oxidation layer 2034 can be gold (Au) or platinum (Pt). The thickness of the anti-oxidation layer 2034 can range from about 0.1 nm to about 10 nm. In one embodiment, the material of the anti-oxidation layer 2034 is platinum (Pt). The thickness of the anti-oxidation layer 2034 is about 2 nm. The anti-oxidation layer 2034 is optional.

The conductivity of the carbon nanotube wire structure with conductive coating on each carbon nanotube is better than the conductivity of the carbon nanotube wire structure without conductive coating on each carbon nanotube. The resistivity of the carbon nanotube wire structure without conductive coating on each carbon nanotube is in a range from about $100\times10^{-8}$ Ω·m to about $700\times10^{-8}$ Ω·m. The resistivity of the carbon nanotube wire structure with conductive coating on each carbon nanotube is in a range from about $10\times10^{-8}$ Ω·m to about $500\times10^{-8}$ Ω·m. Thus, the coil lead wire 200 has good bend resistance and good conductivity, thereby improving the sensitivity of the loudspeaker 200.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A loudspeaker comprising:
- a magnetic system defining a magnetic gap;
- a vibrating system comprising:
- a diaphragm;
- a voice coil bobbin located in the magnetic gap, the diaphragm being fixed to the voice coil bobbin;
- a voice coil wound around the voice coil bobbin; and
- a coil lead wire comprising at least one carbon nanotube wire structure and having a first end and a second end, the first end being electrically connected to the voice coil, the at least one carbon nanotube wire structure comprising a plurality of carbon nanotubes, the coil lead wire is capable of transmitting audio electrical signals into the voice coil; and
- a supporting system comprising a frame fixed to the magnetic system and receiving the vibrating system, the frame having a terminal electrically connected to the second end of the coil lead wire, the diaphragm being received in the frame.

2. The loudspeaker as claimed in claim 1, wherein the plurality of carbon nanotubes is joined end to end by van der Waals attractive force.

3. The loudspeaker as claimed in claim 1, wherein the carbon nanotube wire structure comprises at least one carbon nanotube wire.

4. The loudspeaker as claimed in claim 3, wherein the at least one carbon nanotube wire is a non-twisted carbon nanotube wire comprising the plurality of carbon nanotubes substantially parallel to each other and oriented along a length direction of the non-twisted carbon nanotube wire, and the carbon nanotubes are joined end to end by van der Waals attractive force.

5. The loudspeaker as claimed in claim 3, wherein the at least one carbon nanotube wire is a twisted carbon nanotube wire comprising the plurality of carbon nanotubes aligned in a helix around the axis of the twisted carbon nanotube wire, and the carbon nanotubes are joined end to end by van der Waals attractive force.

6. The loudspeaker as claimed in claim 3, wherein the carbon nanotube wire structure is a bundle structure comprising a plurality of carbon nanotube wires substantially parallel to each other, or a twist structure comprising a plurality of carbon nanotube wires twisted together.

7. The loudspeaker as claimed in claim 1, wherein the plurality of carbon nanotubes are selected from the group consisting of single-walled carbon nanotubes, double-walled carbon nanotubes, and multi-walled carbon nanotubes.

8. The loudspeaker as claimed in claim 1, wherein a diameter of the carbon nanotube wire structure is in a range from about 10 micrometers to about 50 millimeters.

9. The loudspeaker as claimed in claim 1, wherein the coil lead wire is a bundle structure comprising a plurality of carbon nanotube wire structures substantially parallel to each other, or a twisted structure comprising a plurality of carbon nanotube wire structures twisted together.

10. The loudspeaker as claimed in claim 1, wherein the carbon nanotubes are coated with a conductive layer, and the material of the conductive layer comprises copper, silver, gold, or any combination alloy thereof.

11. The loudspeaker as claimed in claim 10, wherein a wetting layer is applied between the outer circumferential surface of the carbon nanotubes and the conductive layer, and the material of the conductive layer comprises iron, cobalt, nickel, palladium, titanium, or any combination alloy thereof.

12. The loudspeaker as claimed in claim 11, wherein a transition layer is disposed between the conductive layer and the wetting layer, and the material of the transition layer comprises copper, silver, or any combination alloy thereof.

13. The loudspeaker as claimed in claim 11, wherein an anti-oxidation layer is disposed on an outer surface of the conductive layer, and the material of anti-oxidation layer comprises gold, platinum, or any combination alloy thereof.

14. A coil lead wire adapted for a loudspeaker, the loudspeaker comprising a voice coil, a frame, and a diaphragm received in the frame, the coil lead wire having a first end electrically connected to the voice coil and a second end electrically connected to the frame; and the coil lead wire comprising a carbon nanotube wire structure comprising a plurality of carbon nanotubes.

15. A coil lead wire adapted for a loudspeaker, the loudspeaker comprising a voice coil, a frame, and a diaphragm received in the frame, the coil lead wire having a first end electrically connected to the voice coil and a second end electrically connected to the frame, the coil lead wire consisting of a plurality of carbon nanotube wires, each of the plurality of carbon nanotube wires consisting of a plurality of carbon nanotubes, and the coil lead wire is capable of bending due to oscillation of the voice coil.

16. The louder speaker as claimed in claim 15, wherein the coil lead wire is fixed to a surface of the diaphragm.

17. The louder speaker as claimed in claim 16, wherein the coil lead wire is fixed to the surface of the diaphragm by a groove defined in the diaphragm.

18. The louder speaker as claimed in claim 1, wherein the coil lead wire consists of a plurality of carbon nanotubes.

* * * * *